US006370698B1

(12) United States Patent
Ahl

(10) Patent No.: US 6,370,698 B1
(45) Date of Patent: Apr. 16, 2002

(54) ANTI-SUFFOCATION HELMET

(76) Inventor: Henry L. Ahl, 7340 Neo St. #B, Downey, CA (US) 90241-4128

( * ) Notice: Subject to any disclaimer, the term of this patent is extended or adjusted under 35 U.S.C. 154(b) by 0 days.

(21) Appl. No.: 09/569,454

(22) Filed: May 12, 2000

(51) Int. Cl.[7] ..... A42B 3/18; A42B 3/28
(52) U.S. Cl. ..... 2/414; 2/242; 2/205; 2/918
(58) Field of Search ..... 2/424, 425, 410, 2/414, 4, 5, 202, 205, 909, 918

(56) References Cited

U.S. PATENT DOCUMENTS

| | | | | | |
|---|---|---|---|---|---|
| 544,832 | A | * | 8/1895 | Senior | 2/5 |
| 603,306 | A | * | 5/1898 | Weil | 2/4 |
| 606,379 | A | * | 6/1898 | Dallinger | 2/5 |
| 1,163,247 | A | * | 12/1915 | McGrew | 2/414 |
| 2,988,749 | A | | 6/1961 | Crouzet | |
| 3,478,365 | A | | 11/1969 | Varga | |
| 3,714,670 | A | * | 2/1973 | Finsilver | 2/918 X |
| 4,141,085 | A | | 2/1979 | Adams, Sr. | |
| 4,215,437 | A | * | 8/1980 | Kao | 2/424 |
| D295,453 | S | | 4/1988 | Asher | |
| 5,075,903 | A | | 12/1991 | Richoux | |
| 5,615,419 | A | | 4/1997 | Williams | |

* cited by examiner

*Primary Examiner*—Peter Nerbun

(57) ABSTRACT

A anti-suffocation helmet for prevent suffocation of a sleeping infant from bedding. The anti-suffocation helmet includes a new anti-suffocation helmet which includes a housing. The housing is divided such that a front side and a back side are defined. The housing has a bottom side and a top side. The top side of the front side is hingedly coupled to the back side. The bottom side has an aperture therein. The front side has an opening therein. A fastening means removably fastens the front side to the back side. A padding means pads the user's head. The padding means is fixedly coupled to an inner surface of the front and back sides.

12 Claims, 2 Drawing Sheets

ANTI-SUFFOCATION HELMET

BACKGROUND OF THE INVENTION

1. Field of the Invention

The present invention relates to helmets and more particularly pertains to a new anti-suffocation helmet for prevent suffocation of a sleeping infant from bedding.

2. Description of the Prior Art

The use of helmets is known in the prior art. More specifically, helmets heretofore devised and utilized are known to consist basically of familiar, expected and obvious structural configurations, notwithstanding the myriad designs encompassed by the crowded prior art which have been developed for the fulfillment of countless objectives and requirements.

Known prior art includes U.S. Pat. No. 3,478,365; U.S. Pat. No. 4,141,085; U.S. Pat. No. 5,075,903; U.S. Pat. No. 2,988,749; U.S. Pat. No. 5,615,419; and U.S. Des. Pat. No. 295,453.

While these devices fulfill their respective, particular objectives and requirements, the aforementioned patents do not disclose a new anti-suffocation helmet. The inventive device includes a housing. The housing is divided such that a front side and a back side are defined. The housing has a bottom side and a top side. The top side of the front side is hingedly coupled to the back side. The bottom side has an aperture therein. The front side has an opening therein. A fastening means removably fastens the front side to the back side. A padding means pads the user's head. The padding means is fixedly coupled to an inner surface of the front and back sides.

In these respects, the anti-suffocation helmet according to the present invention substantially departs from the conventional concepts and designs of the prior art, and in so doing provides an apparatus primarily developed for the purpose of prevent suffocation of a sleeping infant from bedding.

SUMMARY OF THE INVENTION

In view of the foregoing disadvantages inherent in the known types of helmets now present in the prior art, the present invention provides a new anti-suffocation helmet construction wherein the same can be utilized for prevent suffocation of a sleeping infant from bedding.

The general purpose of the present invention, which will be described subsequently in greater detail, is to provide a new anti-suffocation helmet apparatus and method which has many of the advantages of the helmets mentioned heretofore and many novel features that result in a new anti-suffocation helmet which is not anticipated, rendered obvious, suggested, or even implied by any of the prior art helmets, either alone or in any combination thereof.

To attain this, the present invention generally comprises a housing. The housing is divided such that a front side and a back side are defined. The housing has a bottom side and a top side. The top side of the front side is hingedly coupled to the back side. The bottom side has an aperture therein. The front side has an opening therein. A fastening means removably fastens the front side to the back side. A padding means pads the user's head. The padding means is fixedly coupled to an inner surface of the front and back sides.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new anti-suffocation helmet apparatus and method which has many of the advantages of the helmets mentioned heretofore and many novel features that result in a new anti-suffocation helmet which is not anticipated, rendered obvious, suggested, or even implied by any of the prior art helmets, either alone or in any combination thereof.

It is another object of the present invention to provide a new anti-suffocation helmet which may be easily and efficiently manufactured and marketed.

It is a further object of the present invention to provide a new anti-suffocation helmet which is of a durable and reliable construction.

An even further object of the present invention is to provide a new anti-suffocation helmet which is susceptible of a low cost of manufacture with regard to both materials and labor, and which accordingly is then susceptible of low prices of sale to the consuming public, thereby making such anti-suffocation helmet economically available to the buying public.

Still yet another object of the present invention is to provide a new anti-suffocation helmet which provides in the apparatuses and methods of the prior art some of the advantages thereof, while simultaneously overcoming some of the disadvantages normally associated therewith.

Still another object of the present invention is to provide a new anti-suffocation helmet for prevent suffocation of a sleeping infant from bedding.

Yet another object of the present invention is to provide a new anti-suffocation helmet which includes a housing. The housing is divided such that a front side and a back side are defined. The housing has a bottom side and a top side. The top side of the front side is hingedly coupled to the back side. The bottom side has an aperture therein. The front side has an opening therein. A fastening means removably fastens the front side to the back side. A padding means pads the user's head. The padding means is fixedly coupled to an inner surface of the front and back sides.

Still yet another object of the present invention is to provide a new anti-suffocation helmet that has windows for outward viewing by the infant.

Even still another object of the present invention is to provide a new anti-suffocation helmet that a shoulder portion thereon for supporting the housing on the neck of the infant.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
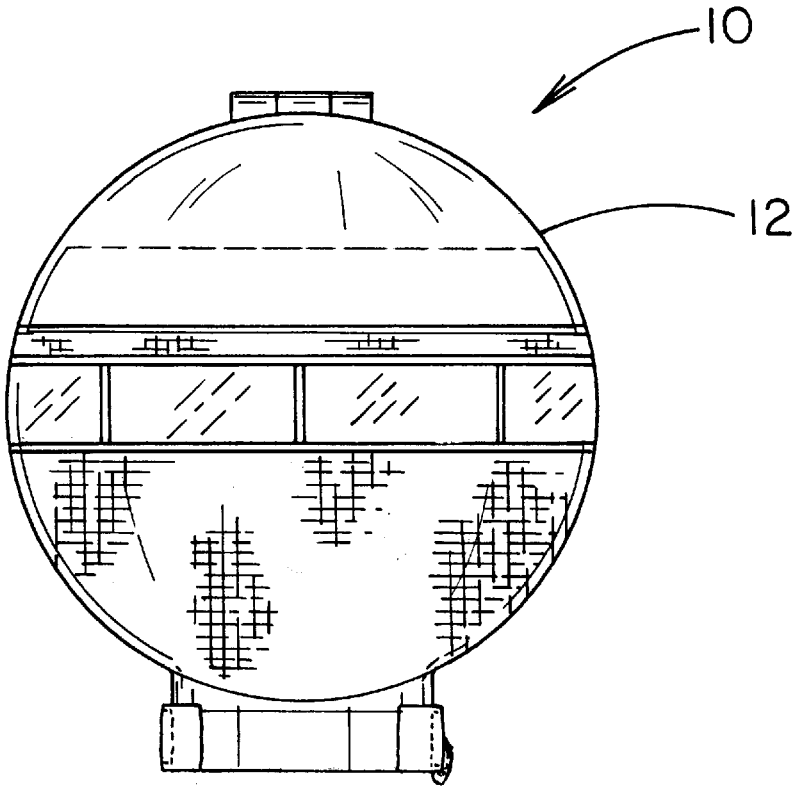
FIG. 1 is a schematic front view of a new anti-suffocation helmet according to the present invention.
Figure 2:
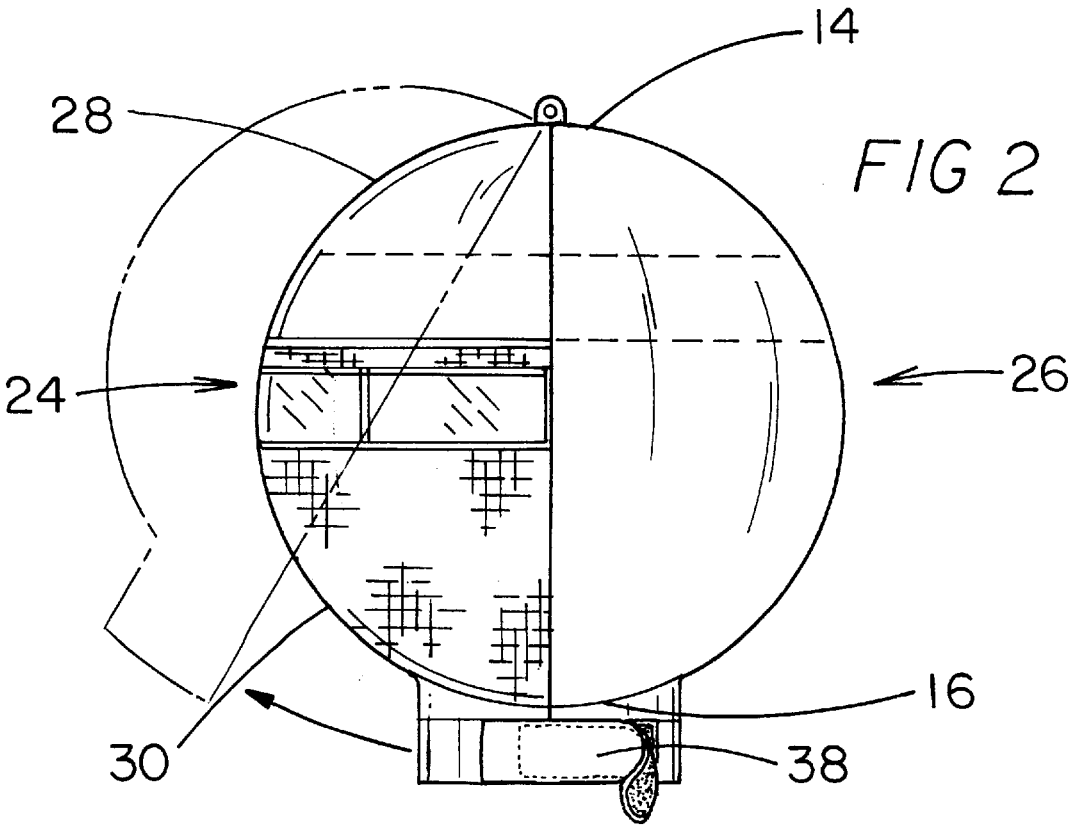
FIG. 2 is a schematic side view of the present invention.
Figure 3:
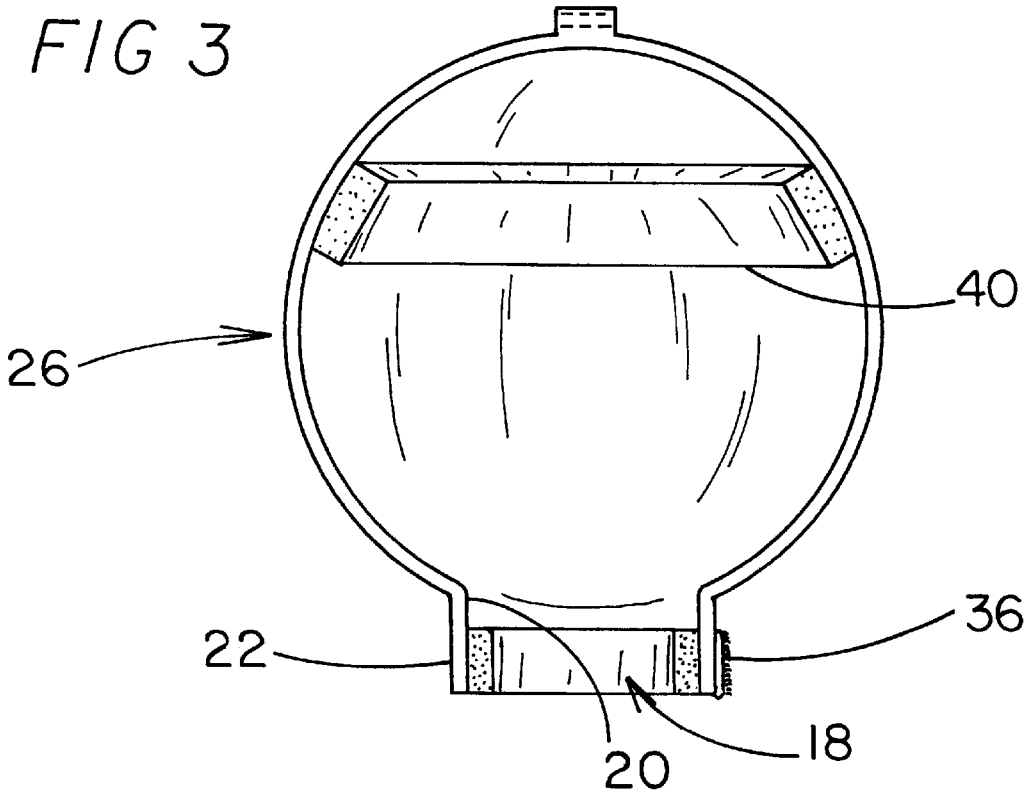
FIG. 3 is a schematic front inner view of the back hemisphere of the present invention.
Figure 4:
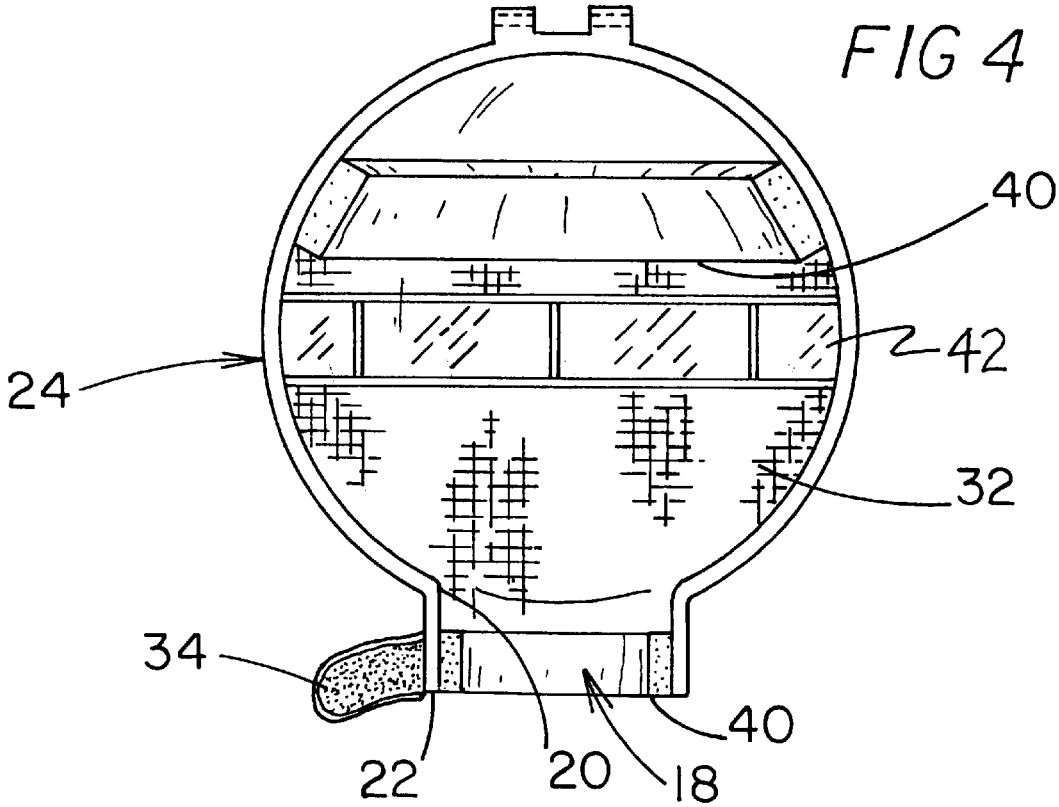
FIG. 4 is a schematic front inner view of the front hemisphere of the present invention.

With reference now to the drawings, and in particular to FIGS. 1 through 4 thereof, a new anti-suffocation helmet embodying the principles and concepts of the present invention and generally designated by the reference numeral 10 will be described.

As best illustrated in FIGS. 1 through 4, the anti-suffocation helmet 10 generally comprises a housing 12. The housing 12 is generally spherically shaped. The housing has a top side 14 and a bottom side 16. The bottom side 16 of the housing has an aperture 18 therein. The aperture has a peripheral edge 20. A shoulder 22 is coupled to and extends downwardly from the peripheral edge 20 of the aperture 18. The housing 12 is divided into two portions such that a front 24 and back 26 hemisphere is defined. The shoulder 22 is divided into two portions, wherein each portion is associated with one hemisphere. The top side 14 of the front hemisphere 24 is hingedly coupled to the top side 14 of the back hemisphere 26 by a hinging means such that the bottom side 16 of the front hemisphere 24 may be pivotally moved away from the bottom side 16 of the back hemisphere 26. The front hemisphere 24 has a bottom half 30 and a top half 30. The bottom half 30 is generally open. A plurality of windows 42 are in the front hemisphere. The windows 42 generally extend along a line between the top 28 and bottom 30 halves. The windows 42 each have a rounded surface so that the windows 42 are generally flush with an exterior surface of the housing 12. The bottom half 30 has a panel 32 therein on, the panel 32 comprises a mesh material such that air may permeate the panel 32. The panel 32 is ideally rigid such that it does not collapse under the weight of a child lying on it. Each of the windows 42 preferably comprises a plastic. The windows may be one continues window.

A fastening means removably fastens the front hemisphere 24 to the back hemisphere 26. The fastening means comprises a hook portion 34 and loop portion 36. The loop portion 36 is fixedly coupled to a first portion of the shoulder 22. A flap 38 is fixedly coupled to a second portion of the shoulder 22. The hook portion 34 is fixedly coupled to the flap 38 such that the hook portion 34 may communicate with the loop portion 36. Ideally, there is a fastening means on each side of the shoulder.

A padding means 40 pads the user's head and protects it from injury. The padding means 40 is fixedly coupled to an inner surface of the front 24 and back 26 hemispheres. The padding means 40 comprises an annular pad. The annular pad is positioned such that the annular pad may be abutted against the cranium of the user when a head is placed in the housing. The padding can be of any conventional padding material used in helmets. The padding may also be placed about the inner surface of the shoulder to protect the infant's neck from the shoulder.

In use, the child's head is placed in the housing 12 and the front 24 and back 26 hemispheres are fastened together. The housing 12 will protect the child's head from injury. Also, the housing 12 will help prevent suffocation for infants, generally younger than one year old, which may happen while they are sleeping. The helmet will prevent their face from coming in contact with bedding so that a breathing space is maintained.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An anti-suffocation device, said device comprising:

a housing being generally spherically shaped, said housing having a solid front side and a solid back side, said housing being divided into two portions such that said front and back sides comprise a front and a back hemisphere respectively, said housing having a bottom side and a top side, said top side of said front side being hingedly coupled to said back side, said bottom side having an aperture therein, said front hemisphere having a bottom half and a top half, said bottom half being generally open and defining an open area such that a peripheral edge of said front hemisphere remains intact, said bottom half having a panel therein on attached to a peripheral edge of said open area, said panel comprising a rigid mesh material such that air may permeate said panel;

a fastening means for removably fastening said front side to said back side; and a padding means for padding the user's head, said padding means being fixedly coupled to an inner surface of said front and back sides, said padding means generally extending around the user's head.

2. The anti-suffocation device as in claim 1, wherein said aperture has a peripheral edge, a shoulder being coupled to and extending downwardly from said peripheral edge of said aperture.

3. The anti-suffocation device as in claim 2, said housing additionally including a plurality of windows being in said front hemisphere, said windows generally extending along a line between said top and bottom halves.

4. The anti-suffocation device as in claim 2, wherein said fastening means comprises a hook portion and loop portion, said loop portion fixedly coupled to a first portion of said shoulder, a flap being fixedly coupled to a second portion of said shoulder, said hook portion being fixedly coupled to said flap such that said hook portion may communicate with said loop portion.

5. The anti-suffocation device as in claim 3, wherein said padding comprises an annular pad, said annular pad being positioned such that the annular pad may be abutted against a forehead, back and sides of a head of the user when the head is placed in said housing.

6. An anti-suffocation device, said device comprising:

a housing, said housing being generally spherically shaped, said housing having a top side and a bottom side, said bottom side of said housing having an aperture therein, said aperture having a peripheral edge, a shoulder being coupled to and extending downwardly from said peripheral edge of said aperture, said housing being divided into two portions such that a front and back hemisphere are defined such that said shoulder is divided into two portions, said top side of said front hemisphere being hingedly coupled to said top side of said back hemisphere such that said bottom side of said front hemisphere may be pivotally moved away from said bottom side of said back hemisphere, said front hemisphere having a bottom half and a top half, said bottom half being generally open, a plurality of windows being in said front hemisphere, said windows generally extending along a line between said top and bottom halves, said bottom half having a panel therein on, said panel comprising a mesh material such that air may permeate said panel, each of said windows comprising a plastic;

a fastening means for removably fastening said front hemisphere to said back hemisphere, said fastening means comprising a hook portion and loop portion, said loop portion fixedly coupled to a first portion of said shoulder, a flap being fixedly coupled to a second portion of said shoulder, said hook portion being fixedly coupled to said flap such that said hook portion may communicate with said loop portion; and a padding means for padding the user's head, said padding means being fixedly coupled to an inner surface of said front and back hemispheres, said padding means comprising an annular pad, said annular pad being positioned such that the annular pad may be abutted against the cranium of the user when a head is placed in said housing.

7. An anti-suffocation device, said device comprising:

a rigid and solid housing being generally spherically shaped, said housing having a front side and a back side, said housing being divided into two portions such that said front and back sides comprise a front and a back hemisphere respectively, said housing having a bottom side and a top side, said top side of said front side being hingedly coupled to said back side, said bottom side having an aperture therein, said front hemisphere having a bottom half and a top half, said bottom half having a generally open area therein such that a peripheral edge of said front hemisphere remains intact;

a fastening means for removably fastening said front side to said back side; and a padding means for padding the user's head, said padding means being fixedly coupled to an inner surface of said front and back sides.

8. The anti-suffocation device as in claim 7, wherein said aperture has a peripheral edge, a shoulder being coupled to and extending downwardly from said peripheral edge of said aperture.

9. The anti-suffocation device as in claim 8, said housing additionally including a plurality of windows being in said front hemisphere, said windows generally extending along a line between said top and bottom halves.

10. The anti-suffocation device as in claim 8, additionally including a panel, said panel being attached to a peripheral edge of said open area, said panel comprising a mesh material such that air may permeate said panel.

11. The anti-suffocation device as in claim 9, wherein said fastening means comprises a hook portion and loop portion, said loop portion fixedly coupled to a first portion of said shoulder, a flap being fixedly coupled to a second portion of said shoulder, said hook portion being fixedly coupled to said flap such that said hook portion may communicate with said loop portion.

12. The anti-suffocation device as in claim 8, wherein said padding comprises an annular pad, said annular pad being positioned such that the annular pad may be abutted against a forehead, back and sides of a head of the user when the head is placed in said housing.

* * * * *